US006617287B2

(12) United States Patent
Gahagan et al.

(10) Patent No.: US 6,617,287 B2
(45) Date of Patent: Sep. 9, 2003

(54) MANUAL TRANSMISSION LUBRICANTS WITH IMPROVED SYNCHROMESH PERFORMANCE

(75) Inventors: Michael P. Gahagan, Derby (GB); Brian M. O'Connor, South Euclid, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 10/036,271

(22) Filed: Oct. 22, 2001

(65) Prior Publication Data

US 2003/0104952 A1 Jun. 5, 2003

(51) Int. Cl.[7] ..... C01M 141/06; C01M 141/10

(52) U.S. Cl. ..... 508/192; 508/186; 508/272; 508/391; 508/436

(58) Field of Search ..... 508/192, 186, 508/391, 272, 436

(56) References Cited

U.S. PATENT DOCUMENTS

| | | | | |
|---|---|---|---|---|
| 2,197,832 A | | 4/1940 | Reiff | 87/9 |
| 2,197,835 A | | 4/1940 | Reiff | 87/9 |
| 2,252,662 A | | 8/1941 | Reiff | 260/429 |
| 2,252,664 A | | 8/1941 | Reiff et al. | 260/429 |
| 2,501,731 A | | 3/1950 | Mertes | 252/33 |
| 2,616,904 A | | 11/1952 | Asseff et al. | 260/399 |
| 2,616,905 A | | 11/1952 | Asseff et al. | 260/399 |
| 2,616,906 A | | 11/1952 | Asseff et al. | 260/399 |
| 2,616,911 A | | 11/1952 | Asseff et al. | 260/413 |
| 2,616,925 A | | 11/1952 | Asseff et al. | 260/504 |
| 2,714,092 A | | 7/1955 | Culname et al. | 252/36 |
| 2,777,874 A | | 1/1957 | Asseff et al. | 260/504 |
| 3,024,237 A | | 3/1962 | Drummond et al. | 260/268 |
| 3,172,892 A | | 3/1965 | LeSuer et al. | 260/326.5 |
| 3,219,666 A | | 11/1965 | Norman et al. | 260/268 |
| 3,242,080 A | | 3/1966 | Wiley et al. | 252/33 |
| 3,245,910 A | | 4/1966 | Berkeley | 252/51.5 |
| 3,250,710 A | | 5/1966 | Hunt | 252/33 |
| 3,256,186 A | | 6/1966 | Greenwald | 252/33 |
| 3,271,310 A | | 9/1966 | LeSuer | 252/35 |
| 3,272,746 A | | 9/1966 | LeSuer | 252/47.5 |
| 3,274,135 A | | 9/1966 | Norman et al. | 260/23 |
| 3,278,550 A | | 10/1966 | Norman | 260/326.3 |
| 3,306,907 A | | 2/1967 | McNinch et al. | 260/326.3 |
| 3,312,619 A | | 4/1967 | Vineyard | 252/47.5 |
| 3,318,809 A | | 5/1967 | Bray | 252/33 |
| 3,320,162 A | | 5/1967 | Axe et al. | 252/33 |
| 3,341,542 A | | 9/1967 | LeSuer | 260/268 |
| 3,365,396 A | | 1/1968 | Schlicht | 252/35 |
| 3,367,943 A | | 2/1968 | Miller et al. | 260/326.3 |
| 3,374,174 A | | 3/1968 | LeSuer | 252/51.5 |
| 3,381,022 A | | 4/1968 | LeSuer | 260/404.8 |
| 3,384,585 A | | 5/1968 | Gragson et al. | 252/33 |
| 3,410,798 A | | 11/1968 | Cohen | 252/37.2 |
| 3,454,607 A | | 7/1969 | LeSuer | 260/408 |
| 3,470,098 A | | 9/1969 | O'Halloran | 252/47.5 |
| 3,488,284 A | | 1/1970 | LeSuer | 252/33 |
| 3,492,231 A | | 1/1970 | McMillen | 252/33 |
| 3,595,791 A | | 7/1971 | Cohen | 252/33.6 |
| 3,629,109 A | | 12/1971 | Gergel et al. | 252/33 |
| 3,630,902 A | | 12/1971 | Coupland et al. | 252/51.5 |
| 3,755,169 A | | 8/1973 | Adams et al. | 252/35 |
| 3,912,764 A | | 10/1975 | Palmer | 260/346.8 |
| 4,136,043 A | | 1/1979 | Davis | 252/47.5 |
| 4,140,643 A | | 2/1979 | Davis | 252/47.5 |
| 4,172,855 A | | 10/1979 | Shubkin et al. | 585/16 |
| 4,230,586 A | | 10/1980 | Bretz et al. | 252/8.5 |
| 4,234,435 A | | 11/1980 | Meinhardt et al. | 252/49.9 |
| 4,368,133 A | | 1/1983 | Forsberg | 252/75 |
| 4,525,289 A | | 6/1985 | Howie et al. | 252/49.9 |
| 4,755,311 A | | 7/1988 | Burjes et al. | 252/49.9 |
| 4,792,410 A | | 12/1988 | Schwind et al. | 252/38 |
| 5,089,156 A | * | 2/1992 | Chrisope et al. | 508/192 |
| 5,354,484 A | * | 10/1994 | Schwind et al. | 508/192 |
| 5,492,638 A | | 2/1996 | Wallace et al. | 252/18 |
| 5,691,283 A | * | 11/1997 | Poat et al. | 508/186 |
| 6,262,000 B1 | | 7/2001 | Reeve et al. | 508/371 |
| 6,451,745 B1 | * | 9/2002 | Ward | 508/192 |

FOREIGN PATENT DOCUMENTS

| | | |
|---|---|---|
| CA | 956397 | 10/1974 |
| EP | 0 407 124 A1 | 1/1991 |
| EP | 0 747 465 A2 | 12/1996 |
| EP | 0761805 | 3/1997 |
| EP | 976 813 | 2/2000 |
| GB | 1085903 | 10/1917 |
| GB | 944136 | 12/1963 |
| GB | 1162436 | 8/1969 |
| GB | 1440219 | 6/1976 |
| WO | WO 87/05927 | 10/1987 |
| WO | WO 87/07638 | 12/1987 |
| WO | WO 88/03551 | 5/1988 |
| WO | WO 97/14771 | 4/1997 |
| WO | WO 00/71646 A1 | 11/2000 |

OTHER PUBLICATIONS

SAE Paper #821181, Axle Efficiency Response to Synthetic Lubricant Components, O'Connor et al.

Kirk–Othmer, Encyclopedia of Chemical Technology, 3rd Ed., 1978, J. Wiley & Sons, NY pp. 814–871.

Yan et al., "Modern Size Exclusion Liquid Chromatographs," J. Wiley & Sons, NY 1979.

"Sulfonates," Kirk–Othmer, Encyclopedia of Chemical Technology, 2nd Ed., vol. 19, pp 291, Wiley & Sons, NY 1969.

Search Report from corresponding PCT International Application PCT/US02/33561 dated Jan. 24, 2003.

* cited by examiner

*Primary Examiner*—Jacqueline V. Howard

(74) *Attorney, Agent, or Firm*—Teresan W. Gilbert; Michael F. Esposito

(57) ABSTRACT

A novel lubricating composition for manual transmissions with improved performance with sintered synchronized components. The lubricating oil composition contains high level of an alkaline earth sulfonate and amine phosphates.

16 Claims, No Drawings

MANUAL TRANSMISSION LUBRICANTS WITH IMPROVED SYNCHROMESH PERFORMANCE

BACKGROUND OF THE INVENTION

The present invention relates to lubricants for manual transmissions with improved performance with sintered synchromesh components. Problems occur with synchromesh parts in a manual transmission with many oils having too low friction or high wear of the components leading to synchromesh damage and poor or failed gear shifts.

The synchronizer is one of the more important components of any manual gearbox. Increasing performance, reducing shift force and minimizing the between-the-gears energy losses are the primary objectives for a new generation of synchronizer systems. Improvements in the capacity of the brass system and the introduction of formed sintered cones are allowing economical re-engineering of existing synchronizer designs into more efficient designs (see Hoerbiger and Co. Engineering Report 32). The chemistry of manual transmission lubricating oils needs to be reformulated for these designs to be able to maintain adequate friction between the sintered cones and protect these parts from wear.

Conventional gear oils or manual transmission oils typically contain chemical components, such as active sulfur and surface-active amine organophosphates. While excellent as additives to provide extreme pressure lubrication, in the usual amounts these additives alone are too slippery and do not adequately protect the sintered surfaces from abrasive or corrosive wear.

Poat et al. in U.S. Pat. No. 5,691,283 disclose a method of operating a vehicle having a manual transmission with a cone synchronizer using fluids with improved friction characteristics containing mineral or synthetic oils, one or more Mannich dispersants including borated Mannich dispersants, metal free sulfur containing antiwear and/or extreme pressure agents, one or more phosphorus containing and nitrogen containing antiwear and/or extreme pressure agents, and overbased alkali metal or alkaline earth metal detergents. The method may employ a finished lubricant in which all or a portion of the base oil is a polyalphaolefin (PAO). Other potential additives are listed including Cu corrosion inhibitors, which may be synonymous with "metal deactivators." No specific ones are named. There is no mention of a synchronizer with sintered metal parts but instead the emphasis is on steel units with molybdenum-based plasma spray coatings. Poat et al. in EP 0 767 236 disclose improving the frictional characteristics of manual transmissions of the synchronizer type with compositions of more than 40% hydrogenated poly-a-olefins and 0.01–2% of an overbased alkaline earth metal sulfurized phenate or salicylate. Additive packages are described as generally containing a sulfur-phosphorus antiwear or extreme-pressure additive system, one or more antioxidants, one or more corrosion inhibitors and an antifoam additive and may, preferably contain a dispersant additive. There is no mention of a specific metal deactivator, and there is no mention of sintered metal parts.

Wallace et al., in U.S. Pat. No. 5,492,638, disclose a method similar to the Poat et al. patent, disclosing the same list of required components but as a method of improving gear shift performance.

Schwind et al. in U.S. Pat. No. 4,792,410 disclose the synchromesh manual transmission fluids. A composition is disclosed in Example IV for a manual transmission fluid containing a mixture of synthetic materials including a majority of PAO as the base stock, a zinc dithiophosphate and dioleylphoshite as extreme pressure (EP)/antiwear agents, a sulfurized olefin EP agent, a magnesium sulfonate detergent, and a borated carbonate overbased sodium sulfonate. Schwind et al. in WO 87/05927 disclose similar examples and claims alkaline earth metal detergents with synthetic oils for manual transmission fluids. No metal deactivators or amine phosphates are disclosed in either and the only boron is in the form of the borated detergent not a borated dispersant. Synchromesh with sintered parts is not disclosed.

Teqjui et al. in EP 0976813 disclose high synchromesh durability performance and gear protection of a manual transmission gearbox. Metal detergents are presented as a required component as overbased salicylates and a calcium sulfonate is shown in the comparative examples. Metal deactivators are described as optional components at up to 7%, with specific mention of up to 3.5% of a dimercaptothiadiazole derivative. The patent discloses specific metal borate containing formulations for manual transmission fluids. The synchromesh durability testing shown involves brass or Mo/steel synchronizers, not sintered metal. No synthetic oil is disclosed.

Shubken et al. in U.S. Pat. No. 4,172,855 disclose a process for manufacturing alpha olefin oligomers useful as synthetic lubricant base oils. Example 2 shows the combination of the PAO with a calcium sulfonate with other additives in an engine crankcase lubricant.

Similarly, Howie et al. in U.S. Pat. No. 4,525,289 in Example IIC disclose a formulation that has a PAO in combination with a overbased calcium sulfonate and an overbased magnesium sulfonate as a crankcase lubricant.

In a paper by O'Connor et al., entitled *Axle Efficiency Response to Synthetic Lubricant Components* (SAE Paper No. 821181), presented at the Fuels and Lubricants Meeting in Toronto, Ontario, Canada, in October 1982) the authors state that "investigations with both partial- and full-synthetic base formulations have shown improvements compared to conventional petroleum based gear oils. Maximum benefits are gained with total synthetic base type formulations." This paper teaches the value of synthetic oils for axle efficiency that would result in fuel savings. The chemistry is not disclosed. The paper mentions that there is a 50% overtreatment of the EP additive to insure GL-5 quality, the gear oil performance standard, and that all EP additives used were commercial SP types. (This would typically mean sulfur(S) as sulfurized olefins and phosphorous(P) as amine phosphates.) There is no disclosure that basic metal detergents would also be present and there is no discussion of manual transmissions, or synchromesh manual transmissions, or the latter with sintered metal parts.

All of the above prior art references reveal the use of the various components in lubricants in some capacity and even some combinations in manual transmissions. None of the references teach the specified combinations of this invention or the advantages of these combinations in manual transmission fluids with sintered metal synchronizers. None of the references address the problems of wear or low friction of fluids in synchromesh manual transmissions with sintered metal parts.

The present invention solves the problem of wear and too low friction in a manual transmission with sintered metal parts in the synchronizer of the transmission by using a lubricating oil formulated with a high level of an alkaline earth sulfonate in combination with amine phosphates.

SUMMARY OF THE INVENTION

The present invention provides a composition suitable for lubricating a manual transmission designed with sintered metal surfaces in the synchronizer, comprising:

(a) at least about 70% by weight of oil of lubricating viscosity of API Group III, IV, V or mixtures thereof, (b) about 0.01 to about 2% by weight of an amine salt of a phosphorus containing acid, (c) at least about 0.5% by weight of a basic metal salt of an organic acid, (d) about 0% to about 0.7% by weight of a metal deactivator compound, and (e) about 0% to about 3% by weight of a boron-containing dispersant.

The present invention further provides a method for preventing wear of sintered metal surfaces in the synchronizer of a manual transmission and improving performance by using a lubricant of the composition of the present invention. The lubricating composition is characterized by the selection of a stable base oil and high levels of metal detergents, an amine phosphate extreme-pressure agent and other gear oil additives. The method further enhances performance with the addition of either or both of the metal deactivator compound and/or the boron-containing dispersant to the lubricating composition.

DETAILED DESCRIPTION OF THE INVENTION

Various preferred features and embodiments will be described below by way of non-limiting illustration.

Component (a) of the lubricating composition is an oil of lubricating viscosity of API Group III, IV or V. Specific examples of this type of component include but are not limited to severely hydrogenated mineral oils (Group III), polyalpha-olefins (PAOs) (Group IV) or other synthetics (Group V) such as alkyl benzenes.

The amount of component (a) in the compositions of the present invention is generally in the range of about 70% to about 96% by weight of the lubricating composition. Preferably the amount of component (a) is in the range of about 80% to about 95% by weight of the lubricating composition. More preferably the amount of component (a) is in the range of about 85% to about 93% by weight of the lubricating composition.

Preferably component (a) is a Group III or Group IV oil or mixture of both. Preferably component (a) comprises about at least 35% by weight PAO, more preferably about at least 50% by weight PAO, and most preferably about at least 70% by weight PAO.

Component (b) of the lubricating composition is an amine salt of a phosphorus-containing acid. Specific examples of this type of component include but are not limited to amine salts of partial esters of phosphoric or thiophosphoric acids.

In one embodiment, the phosphorus-containing acid is a phosphorus acid ester prepared by reacting one or more phosphorus acid or anhydride with an alcohol containing from one to about 3 carbon atoms. The alcohol generally contains up to about 30, preferably up to about 24, and more preferably up to about 12 carbon atoms. The phosphorus acid or anhydride is generally an inorganic phosphorus reagent, such as phosphorus pentoxide, phosphorus trioxide, phosphorus tetroxide, phosphorus acid, phosphorus halide, lower phosphorus esters, or a phosphorus sulfide, including phosphorus pentasulfide, and the like. Examples of phosphorus acids or anhydrides include phosphorus pentoxide, phosphorus pentasulfide and phosphorus trichloride. Lower phosphorus acid esters generally contain from 1 to about 7 carbon atoms in each ester group. The phosphorus acid ester may be a mono- or diphosphoric acid esters. Alcohols used to prepare the phosphorus acid esters include but are not limited to butyl, amyl, 2-ethylhexyl, hexyl, octyl, decyl and oleyl alcohols and the like. Examples of commercially available alcohols include Alfol 810 (a mixture of primarily straight chain, primary alcohols having from 8 to 10 carbon atoms); Alfol 1218 (a mixture of synthetic, primary, straight-chain alcohols containing 12 to 18 carbon atoms); Alfol 20+ alcohols (mixtures of $C_{18}$–$C_{28}$ primary alcohols having mostly $C_{20}$ alcohols as determined by GLC (gas-liquid-chromatography)); and Alfol 22+ alcohols ($C_{18}$–$C_{28}$ primary alcohols containing primarily $C_{22}$ alcohols). Alfol alcohols are available from Conoco.

Other examples of commercially available alcohol mixtures are Adol 60 (about 75% by weight of a straight chain $C_{22}$ primary alcohol, about 15% of a $C_{20}$ primary alcohol and about 8% of $C_{18}$ and $C_{24}$ alcohols) and Adol 320 (oleyl alcohol). The Adol alcohols are available from Ashland Chemical.

A variety of mixtures of monohydric fatty alcohols derived from naturally occurring triglycerides and ranging in chain length of from about $C_8$ to $C_{18}$ are available from Procter & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$ to $C_{15}$ alcohols; and Neodol 45 is a mixture of $C_{14}$ to $C_{15}$ linear alcohols. Neodol 91 is a mixture of $C_9$, $C_{10}$ and $C_{11}$ alcohols.

Fatty vicinal diols also are useful and these include those available from Ashland Oil under the general trade designation Adol 114 and Adol 158. The former is derived from a straight chain alpha olefin fraction of $C_{11}$–$C_{14}$, and the latter is derived from a $C_{15}$–$C_{18}$ fraction.

In another embodiment, the phosphorus-containing acid is a thiophosphorus acid ester. The thiophosphorus acid esters may be mono- or dithiophosphorus acid esters. Thiophosphorus acid esters are also referred to generally as thiophosphoric acids. The thiophosphorus acid ester may be prepared by reacting a phosphorus sulfide, such as those described above, with an alcohol, such as those described above.

In one embodiment, the phosphorus acid ester is a monothiophosphoric acid ester or a monothiophosphate. Monothiophosphates may be prepared by the reaction of a sulfur source with a dihydrocarbyl phosphite. The sulfur source may for instance be elemental sulfur. The sulfur source may also be an organosufide, such as a sulfur coupled olefin or a sulfur coupled dithiophosphate. Elemental sulfur is a preferred sulfur source. The preparation of monothiophosphates is disclosed in U.S. Pat. No. 4,755,311 and PCT Publication WO 87/07638, incorporated herein by reference for their disclosure of monothiophosphates, sulfur sources, and the process for making monothiophosphates. Monothiophosphates may also be formed in the lubricant blend by adding a dihydrocarbyl phosphite to a lubricating composition containing a sulfur source, such as a sulfurized olefin. The phosphite may-react with the sulfur source under blending conditions (i.e., temperatures from about 30° C. to about 100° C. or higher) to form the monothiophosphate salt with an amine which is present in the blend.

In another embodiment, the phosphorus-containing acid is a dithiophosphoric acid or phosphorodithioic acid. The dithiophosphoric acid may be represented by the formula $(RO)_2PSSH$ wherein each R is independently a hydrocarbyl group containing from about 3 to about 30 carbon atoms. R generally contains up to about 18, preferably to about 12, and more preferably to about 8 carbon atoms. Examples of R include but are not limited to isopropyl, isobutyl, n-butyl, sec-butyl, the various amyl, n-hexyl, methylisobutyl carbinyl, heptyl, 2-ethylhexyl, isooctyl, nonyl, behenyl, decyl, dodecyl, tridecyl groups and the like. Illustrative lower alkylphenyl R groups include butylphenyl, amylphenyl, heptylphenyl and the like. Examples of mixtures of R groups include, but are not limited to 1-butyl and 1-octyl; 1-pentyl and 2-ethyl-1-hexyl; isobutyl and n-hexyl; isobutyl and isoamyl; 2-propyl and 2-methyl-4-pentyl; isopropyl and sec-butyl; and isopropyl, isooctyl and the like.

In one embodiment, the dithiophosphoric acid may be reacted with an epoxide or a glycol. This reaction product is further reacted with a phosphorus acid, anhydride, or lower ester. The epoxide is generally an aliphatic epoxide or a styrene oxide. Examples of useful epoxides include ethylene oxide, propylene oxide, butene oxide, octene oxide, dodecene oxide, styrene oxide and the like. Propylene oxide is preferred. The glycols may be aliphatic glycols having from 1 to 12, preferably 2 to 6, and more preferably 2 or 3 carbon atoms. The dithiophosphoric acids, glycols, epoxides, inorganic phosphorus reagents and methods of reacting the same are described in U.S. Pat. Nos. 3,197,405 and 3,544,465, incorporated herein by reference for their disclosure to these.

The following Examples B-1 and B-2 exemplify the preparation of useful phosphorus acid esters.

Example B-1

Phosphorus pentoxide (about 64 grams) is added at about 58° C. over a period of about 45 minutes to about 514 grams of hydroxypropyl O,O-di(4-methyl-2-pentyl) phosphorodithioate (prepared by reacting di(4-methyl-2-pentyl)-phosphorodithioic acid with about 1.3 moles of propylene oxide at about 25° C.). The mixture is heated at about 75° C. for about 2.5 hours, mixed with a diatomaceous earth and filtered at about 70° C. The filtrate contains about 11.8% by weight phosphorus, about 15.2% by weight sulfur, and an acid number of 87 (bromophenol blue).

Example B-2

A mixture of about 667 grams of phosphorus pentoxide and the reaction product of about 3514 grams of diisopropyl phosphorodithioic acid with about 986 grams of propylene oxide at about 50° C. is heated at about 85° C. for about 3 hours and filtered. The filtrate contains about 15.3% by weight phosphorus, about 19.6% by weight sulfur, and an acid number of 126 (bromophenol blue).

Acidic phosphoric acid esters may be reacted with ammonia or an amine compound to form an ammonium salt. The salts may be formed separately and then the salt of the phosphorus acid ester may be added to the lubricating composition. Alternately, the salts may also be formed in situ when the acidic phosphorus acid ester is blended with other components to form a fully formulated lubricating composition.

The amine salts of the phosphorus acid esters may be formed from ammonia, or an amine, including monoamines and polyamines. The amines may be primary amines, secondary amines or tertiary amines. In one embodiment, the amines are one or more of the amines described above for preparing the dithiocarbamates. Useful amines include those amines disclosed in U.S. Pat. No. 4,234,435 at Col. 21, line 9 to Col. 22, line 5, these passages being incorporated herein by reference.

The monoamines generally contain from 1 up to about 24 carbon atoms, or up to about 14, or up to about 8 carbon atoms. Examples of monoamines include but are not limited to methylamine, ethylamine, propylamine, butylamine, octylamine, and dodecylamine, dimethylamine, diethylamine, dipropylamine, dibutylamine, methyl butylamine, ethyl hexylamine, trimethylamine, tributylamine, methyl diethylamine, ethyl dibutylamine and the like.

In one embodiment, the amine may be a fatty ($C_{4-30}$) amine that include but are not limited to n-hexylamine, n-octylamine, n-decylamine, n-dodecylamine, n-tetradecylamine, n-hexadecylamine, n-octadecylamine, oleylamine and the like. Some examples are commercially available fatty amines such as "Armeen" amines (products available from Armak Chemicals, Chicago, Ill.), such as Armak's Armeen-C, Armeen-O, Armeen-OL, Armeen-T, Armeen-HT, Armeen S and Armeen SD, wherein the letter designation relates to the fatty group, such as cocoa, oleyl, tallow, or soya groups.

A useful amine is a C1214 branched tertiary alkyl primary amine supplied by Rohm and Haas under the trade name Primene 81R. A particularly preferred (b) is a salt of this amine and the acid of Example B-1.

Other useful amines include primary ether amines, such as those represented by the formula, $R''(OR')_xNH_2$, wherein R' is a divalent alkylene group having about 2 to about 6 carbon atoms, x is a number from one to about 150, and R" is a hydrocarbyl group of about 5 to about 150 carbon atoms. An example of an ether amine is available under the name SURFAM® amines produced and marketed by Mars Chemical Company, Atlanta, Ga. Preferred etheramines are exemplified by those identified as SURFAM P14B (decyloxypropylamine), SURFAM P16A (linear $C_{16}$), SURFAM P17B (tridecyloxypropylamine). The carbon chain lengths (i.e., $C_{14}$, etc.) of the SURFAMS described above and used hereinafter are approximate and include the oxygen ether linkage.

In one embodiment, the amine may be a hydroxyamine. Typically, the hydroxyamines are primary, secondary or tertiary alkanol amines or mixtures thereof. Such amines can be represented by the formulae: $H_2N—R'—OH$, $H(R'_1)N—R'—OH$, and $(R'_1)_2N—R'—OH$, wherein each R', is independently a hydrocarbyl group having from one to about eight carbon atoms or hydroxyhydrocarbyl group having from one to about eight carbon atoms and preferably from one to about four, and R' is a divalent hydrocarbyl group of about two to about 18 carbon atoms, or from two to about four. The group —R'—OH in such formulae represents the hydroxyhydrocarbyl group. R' can be an acyclic, alicyclic or aromatic group. Typically, R' is an acyclic straight or branched alkylene group such as an ethylene, propylene, 1,2-butylene, 1,2-octadecylene, etc. group. Where two R'1 groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include but are not limited to N-(hydroxyl lower alkyl)-morpholines, -thiomorpholines, -piperidines, -oxazolidines, -thiazolidines and the like. Typically, however, each $R'_1$ is independently a methyl, ethyl, propyl, butyl, pentyl or hexyl group. Examples of these alkanolamines include but are not limited to mono-, di-, and triethanolamine, diethylethanolamine, ethylethanolamine, butyldiethanolamine and the like.

The hydroxyamines may also be an ether N-(hydroxyhydrocarbyl)amine. These are hydroxypoly (hydrocarbyloxy) analogs of the above-described hydroxyamines (these analogs also include hydroxyl-substituted oxyalkylene analogs). Such N-(hydroxyhydrocarbyl) amines can be conveniently prepared by reaction of one or more of the above epoxides with afore described amines and may be represented by the formulae: $H_2N—(R'O)_x—H$, $H(R'_1)—N—(R'O)_x—H$, and $(R'_1)_2—N—(R'O)_x—H$, wherein x is a number from about 2 to about 15 and $R_1$ and R' are as described above. $R'_1$ may also be a hydroxypoly(hydrocarbyloxy) group.

The amines may be hydroxyamines, such as those represented by the formula

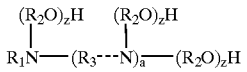

wherein $R_1$ is a hydrocarbyl group generally containing from about 6 to about 30 carbon atoms; $R_2$ and each $R_3$ is independently an alkylene group containing up to about 5 carbon atoms, or an ethylene or propylene group; a is zero or one; and each z is independently a number from zero to about 10, with the proviso that at least one z is at least one. These hydroxyamines can be prepared by techniques well known in the art and many such hydroxyamines are commercially available. The hydroxy amines include mixtures of amines such as obtained by the hydrolysis of fatty oils (e.g., tallow oils, sperm oils, coconut oils, etc.). Specific examples of fatty amines, containing from about 6 to about 30 carbon atoms, include saturated as well as unsaturated aliphatic amines, such as octyl amine, decyl amine, lauryl amine, stearyl amine, oleyl amine, dodecyl amine, and octadecyl amine.

Useful hydroxyamines wherein a in the above formula is zero include N-(2-hydroxyethyl)hexylamine; N-(2-hydroxyethyl) octylamine; N-(2-hydroxyethyl) pentadecylamine; N-(2-hydroxyethyl)oleylamine; N-(2-hydroxyethyl) soyamine; N,N-bis(2-hydroxyethyl) hexylamine; N,N-bis (2-hydroxyethyl)oleylamine; and mixtures thereof. Also included are the comparable members wherein in the above formula at least one of z is at least 2, as for example, N-(2-hydroxyethoxyethyl)hexylamine or N,N-bis(2-hydroxyethoxyethyl)oleylamine.

A number of hydroxyamines wherein a in the above formula is zero are available from the Armak Chemical Division of Akzo, Inc., Chicago, Ill., under the general trade designations "Ethomeen" and "Propomeen". Specific examples of such products include Ethomeen C/15 which is an ethylene oxide condensate of a coco alkyl amine containing about 5 moles of ethylene oxide; Ethomeen C/20 and C/25 which are ethylene oxide condensation products from coco alkyl amine containing about 10 and 15 moles of ethylene oxide, respectively; Ethomeen O/12 which is an ethylene oxide condensation product of oleylamine containing about 2 moles of ethylene oxide per mole of amine; Ethomeen S/15 and S/20 which are ethylene oxide condensation products with stearyl amine containing about 5 and 10 moles of ethylene oxide per mole of amine, respectively; Ethomeen T/12, T/15 and T/25 which are ethylene oxide condensation products of tallow amine containing about 2, 5 and 15 moles of ethylene oxide per mole of amine, respectively; and Propomeen O/12 which is the condensation product of one mole of oleylamine with 2 moles propylene oxide.

Commercially available examples of alkoxylated amines where a in the L above formula is one include Ethoduomeen T/13 and T/20 which are ethylene oxide condensation products of N-tallow trimethylenediamine containing 3 and 10 moles of ethylene oxide per mole of diamine, respectively.

The amine may also be a polyamine. The polyamines include alkoxylated diamines, fatty diamines, alkylenepolyamines, hydroxy-containing polyamines, condensed polyamines and heterocyclic polyamines. Commercially available examples of alkoxylated diamines include those amines where a in the above formula is one. Examples of these amines include Ethoduomeen T/13 and T/20 that are ethylene oxide condensation products of N-tallowtrimethylenediamine containing 3 and 10 moles of ethylene oxide per mole of diamine, respectively.

In another embodiment, the polyamine is a fatty diamine. The fatty diamines include mono- or dialkyl, symmetrical or asymmetrical ethylenediamines, propanediamines (1,2, or 1,3), and polyamine analogs of the above. Suitable commercial fatty polyamines are Duomeen C (N-coco-1,3-diaminopropane), Duomeen S (N-soya-1,3-diaminopropane), Duomeen T (N-tallow-1,3-diaminopropane), and Duomeen O (N-oleyl-1,3-diaminopropane). "Duomeens" are commercially available from Armak Chemical Co., Chicago, Ill.

In another embodiment, the amine is a heterocyclic amine. The heterocyclic polyamines include but are not limited to aziridines, azetidines, azolidines, tetra- and dihydropyridines, pyrroles, indoles, piperidines, imidazoles, di- and tetrahydroimidazoles, piperazines, isoindoles, purines, morpholines, thiomorpholines, N-aminoalkylmorpholines, N-aminoalkylthiomorpholines, N-aminoalkylpiperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl-substituted piperidines, piperazine, aminoalkyl-substituted piperazines, morpholine, aminoalkyl-substituted morpholines, pyrrolidine, and aminoalkyl-substituted pyrrolidines are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic amines are also useful. Examples include N-(2-hydroxyethyl) cyclohexylamine, 3-hydroxycyclopentylamine, parahydroxyaniline, N-hydroxyethylpiperazine, and the like.

The amount of component (b) in the lubricating composition of the present invention is generally in the range of about 0.01% to about 2% by weight of the lubricating composition. Preferably the amount of component (b) is in the range of about 0.05% to about 1.5% by weight of the lubricating composition. More preferably the amount of component (b) is in the range of about 0.1% to about 0.8%. The amount of phosphorus delivered by component (b) is preferably in the range of about 0.004% to about 0.13% P and more preferably in the range of about 0.01% to about 0.05% P of component (b).

Component (c) of the lubricating composition is a basic metal salt of an organic acid. Specific examples of this type of component include but are not limited to overbased magnesium alkylbenzene sulfonates, overbased calcium alkylbenzene sulfonates and the like.

Component (c) contains at least one basic metal salt of an acidic organic compound. These salts are generally referred to as overbased materials or overbased metal salts. Overbased materials are single phase, homogeneous Newtonian systems characterized by a metal content in excess of that which would be present according to the stoichiometry of the metal and the particular acidic organic compound reacted with the metal.

The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The basic salts of the present invention have a metal ratio of about 1.5 up to about 40, preferably of about 3 up to about 25, more preferably of about 7 up to about 20.

The basicity of the overbased materials generally is expressed in terms of a total base number. A total base number is the amount of acid (perchloric or hydrochloric) needed to neutralize all of the overbased material's basicity. The amount of acid is expressed as potassium hydroxide equivalents. Total base number is determined by titration of one gram of overbased material with 0.1 Normal hydrochloric acid solution using bromophenol blue as an indicator. The overbased materials of the present invention generally have a total base number from about 20 to about 700, preferably from about 100 to about 600, and more preferably from about 250 to about 500.

The equivalents of overbased material is determined by the following equation: equivalent weight=(56,100/total base number). For instance, an overbased material with a total base number of 200 has an equivalent weight of 280.5 (eq.wt.=56100/200). The overbased materials (c) are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter.

The acidic organic compounds useful in making the overbased compositions of the present invention include carboxylic acids, sulfonic acids, phosphorus-containing acids, phenols or mixtures thereof. Preferably, the acidic organic compounds are carboxylic acids or sulfonic acids with sulfonic and salicylic acids more preferred. Throughout this specification and in the appended claims, any reference to acids, such as carboxylic acids, is intended to include the acid-producing derivatives thereof such as anhydrides, lower alkyl esters, acyl halides, lactones and mixtures thereof unless otherwise specifically stated.

The carboxylic acids useful in making the overbased salts (c) of the invention may be aliphatic or aromatic, mono- or polycarboxylic acid or acid-producing compounds. These carboxylic acids include lower molecular weight carboxylic acids (e.g., carboxylic acids having up to about 22 carbon atoms such as acids having about 4 to about 22 carbon atoms or tetrapropenyl-substituted succinic anhydride) as well as higher molecular weight carboxylic acids.

The carboxylic acids are preferably oil-soluble. Usually, in order to provide the desired oil-solubility, the number of carbon atoms in the carboxylic acid should be at least about 8, preferably at least about 18, more preferably at least about 30. Generally, these carboxylic acids do not contain more than about 400 carbon atoms per molecule.

The lower molecular weight monocarboxylic acids contemplated for use in this invention include saturated and unsaturated acids. Examples of such useful acids include dodecanoic acid, decanoic acid, oleic acid, stearic acid, linoleic acid, tall oil acid and the like. Mixtures of two or more such agents can also be used. An extensive discussion of these acids is found in Kirk-Othmer "Encyclopedia of Chemical Technology," Third Edition, 1978, John Wiley & Sons, New York, pp. 814–871; these pages being incorporated herein by reference.

The monocarboxylic acids include isoaliphatic acids. Such acids often contain a principal chain having from about 14 to about 20 saturated, aliphatic carbon atoms and at least one but usually no more than about four pendant acyclic lower alkyl groups. Specific examples of such isoaliphatic acids include isostearic acid, 10-methyl-tetradecanoic acid, 3-ethyl-hexadecanoic acid, and 8-methyl-octadecanoic acid. The isoaliphatic acids include mixtures of branch-chain acids prepared by the isomerization of commercial fatty acids (oleic, linoleic or tall oil acids) of, for example, about 16 to about 20 carbon atoms.

High molecular weight carboxylic acids may also be used in the present invention. These acids have a substituent group derived from a polyalkene. The polyalkene is characterized as containing at least about 30 carbon atoms up to about 300, preferably at least about 50 up to about 200 carbon atoms. In one embodiment, the polyalkene is characterized by an Mn (number average molecular weight) value of at least about 500, generally about 500 to about 4000, preferably about 800 to about 2500. In another embodiment, Mn varies between about 500 to about 1200 or 1300.

The polyalkenes include homopolymers and interpolymers of polymerizable olefin monomers of 2 to about 16 carbon atoms. The olefins may be monoolefins such as ethylene, propylene, 1-butene, isobutene, and 1-octene; or a polyolefinic monomer, preferably diolefinic, monomer such 1,3-butadiene and isoprene. Preferably the monomers contain from 2 to about 6 carbon atoms, more preferably 2 to about 4, more preferably 4. The interpolymers include copolymers, terpolymers, tetrapolymers and the like. Preferably, the interpolymer is a homopolymer. An example of a preferred homopolymer is a polybutene, preferably a polybutene in which about 50% of the polymer is derived from isobutylene. The polyalkenes are prepared by conventional procedures.

In one embodiment, the polyalkene is characterized as containing from about 8 up to about 300, preferably from about 30 up to about 200, and more preferably from about 35 up to about 100 carbon atoms. In one embodiment, the polyalkene is characterized by an Mn (number average molecular weight) of at least about 400 or at least about 500. Generally, the polyalkene is characterized by having an Mn from about 500 up to about 5000, or from about 700 up to about 3000, or from about 800 up to 2500, or from about 900 up to about 2000. In another embodiment, Mn varies from about 500 up to about 1500, or from about 700 up to about 1300, or from about 800 up to about 1200.

The abbreviation Mn is the conventional symbol representing number average molecular weight. Gel permeation chromatography (GPC) is a method that provides both weight average and number average molecular weights as well as the entire molecular weight distribution of the polymers. For purpose of this invention a series of fractionated polymers of isobutene, polyisobutene, is used as the calibration standard in the GPC. The techniques for determining Mn and Mw values of polymers are well known and are described in numerous books and articles. For example, methods for the determination of n and molecular weight distribution of polymers is described in W. W. Yan, J. J. Kirkland and D. D. Bly, "Modern Size Exclusion Liquid Chromatographs," J. Wiley & Sons, Inc., 1979.

In another embodiment, the carboxylic acids are aromatic carboxylic acids. A group of useful aromatic carboxylic acids are those of the formula

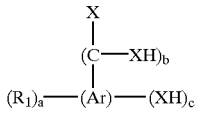

wherein $R_1$ is an aliphatic hydrocarbyl group of preferably about 4 to about 400 carbon atoms, a is a number in the range of zero to about 4, usually 1 or 2, Ar is an aromatic group, each X is independently sulfur or oxygen, preferably oxygen, b is a number in the range of from 1 to about 4, usually 1 or 2, c is a number in the range of zero to about 4, usually 1 to 2, with the proviso that the sum of a, b and c does not exceed the number of valences of Ar. Preferably, $R_1$ and a are such that there is an average of at least about 8 aliphatic carbon atoms provided by the $R_1$ groups. Examples of aromatic carboxylic acids include substituted and non-substituted benzoic, phthalic and salicylic acids or anhydrides.

The $R_1$ group is a hydrocarbyl group that is directly bonded to the aromatic group Ar. $R_1$ preferably contains about 6 to about 80 carbon atoms, preferably about 6 to about 30 carbon atoms, more preferably about 8 to about 25 carbon atoms, and advantageously about 8 to about 15 carbon atoms. $R_1$ groups may be derived form one or more of the above-described polyalkenes. Examples of $R_1$ groups include but are not limited to butyl, isobutyl, pentyl, octyl, nonyl, dodecyl, and substituents derived from the above-described polyalkenes such as polyethylenes, polypropylenes, polyisobutylenes, ethylene-propylene copolymers, oxidized ethylene-propylene copolymers, and the like.

The aromatic group Ar may have the same structure as any of the aromatic groups Ar discussed below. Examples of the aromatic groups that are useful herein include the polyvalent aromatic groups derived from benzene, naphthalene, anthracene, etc., preferably benzene. Specific examples of Ar groups include phenylenes and naphthylenes, methylphenylenes, ethoxyphenylenes, isopropylphenylenes, hydroxyphenylenes, dipropoxynaphthylenes and the like.

Within this group of aromatic acids, a useful class of carboxylic acids are those of the formula

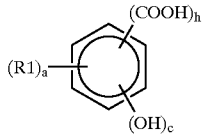

wherein $R_1$ is defined above, a is a number in the range of from zero to about 4, preferably 1 to about 2; b is a number in the range of 1 to about 4, preferably 1 to about 2, c is a number in the range of zero to about 4, preferably 1 to about 2, and more preferably 1; with the proviso that the sum of a, b and c does not exceed 6. Preferably, $R_1$ and a are such that the acid molecules contain at least an average of about 12 aliphatic carbon atoms in the aliphatic hydrocarbon substituents per acid molecule. Preferably, b and c are each one and the carboxylic acid is a salicylic acid.

The salicylic acids can be aliphatic hydrocarbon-substituted salicylic acids wherein each aliphatic hydrocarbon substituent contains an average of at least about 8 carbon atoms per substituent and 1 to 3 substituents per molecule. Overbased salts prepared from such salicylic acids wherein the aliphatic hydrocarbon substituents are derived from the above-described polyalkenes, particularly polymerized lower 1-mono-olefins such as polyethylene, polypropylene, polyisobutylene, ethylene/propylene copolymers and the like and having average carbon contents of about 30 to about 400 carbon atoms are particularly useful.

The above aromatic carboxylic acids are well known or can be prepared according to procedures known in the art. Carboxylic acids of the type illustrated by these formulae and processes for preparing their neutral and basic metal salts are well known and disclosed, for example, in U.S. Pat. Nos. 2,197,832; 2,197,835; 2,252,662; 2,252,664; 2,714,092; 3,410,798; and 3,595,791.

The sulfonic acids useful in making the overbased salts (c) of the invention include the sulfonic and thiosulfonic acids. Generally they are salts of sulfonic acids. The sulfonic acids include the mono- or polynuclear aromatic or cycloaliphatic compounds. The oil-soluble sulfonates can be represented for the most part by one of the following formulae: $R_2$—T—$(SO_3)_a$ and $R_3$—$(SO_3)_b$, wherein T is a cyclic nucleus such as, for example, benzene, naphthalene, anthracene, diphenylene oxide, diphenylene sulfide, petroleum naphthenes, etc.; $R_2$ is an aliphatic group such as alkyl, alkenyl, alkoxy, alkoxyalkyl, etc.; $(R_2)$+T contains a total of at least about 15 carbon atoms; and $R_3$ is an aliphatic hydrocarbyl group containing at least about 15 carbon atoms. Examples of $R_3$ are alkyl, alkenyl, alkoxyalkyl, carboalkoxyalkyl, etc. Specific examples of $R_3$ are groups derived from petrolatum, saturated and unsaturated paraffin wax, and the above-described polyalkenes. The groups T, $R_2$, and $R_3$ in the above Formulae can also contain other inorganic or organic substituents in addition to those enumerated above such as, for example, hydroxy, mercapto, halogen, nitro, amino, nitroso, sulfide, disulfide, etc. In the above Formulae, a and b are at least 1. In one embodiment, the sulfonic acids have a substituent ($R_2$ or $R_3$) which is derived from one of the above-described polyalkenes.

Illustrative examples of these sulfonic acids include monoeicosanyl-substituted naphthalene sulfonic acids, dodecylbenzene sulfonic acids, didodecylbenzene sulfonic acids, dinonylbenzene sulfonic acids, cetylchlorobenzene sulfonic acids, dilauryl beta-naphthalene sulfonic acids, the sulfonic acid derived by the treatment of polybutene having a number average molecular weight (Mn) in the range of 500 to 5000, preferably 800 to 2000, more preferably about 1500 with chlorosulfonic acid, nitronaphthalene sulfonic acid, paraffin wax sulfonic acid, cetylcyclopentane, sulfonic acid, laurylcyclohexane sulfonic acids, polyethylenyl-substituted sulfonic acids derived from polyethylene (Mn=300–1000, preferably 750), etc. Normally the aliphatic groups will be alkyl and/or alkenyl groups such that the total number of aliphatic carbons is at least about 8, preferably at least 12 up to about 400 carbon atoms, preferably up to about 250.

Another group of sulfonic acids are mono-, di-, and tri-alkylated benzene and naphthalene (including hydrogenated forms thereof) sulfonic acids. Illustrative of synthetically produced alkylated benzene and naphthalene sulfonic acids are those containing alkyl substituents having from about 8 to about 30 carbon atoms, preferably about 12 to about 30 carbon atoms, and most preferably about 24 carbon atoms. Such acids include di-isododecylbenzene sulfonic acid, polybutenyl-substituted sulfonic acid, polypropylenyl-substituted sulfonic acids derived from polypropene having an Mn=300–1000, preferably 500–700, cetylchlorobenzene sulfonic acid, dicetylnaphthalene sulfonic acid, dilauryldiphenylether sulfonic acid, diisononylbenzene sulfonic acid, diisooctadecylbenzene sulfonic acid, stearylnaphthalene sulfonic acid, and the like.

Specific examples of oil-soluble sulfonic acids are mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono- and poly-wax-substituted sulfonic and polysulfonic acids of, e.g., benzene, naphthalene, phenol, diphenyl ether, naphthalene disulfide, etc.; other substituted sulfonic acids such as alkyl benzene sulfonic acids (where the alkyl group has at least 8 carbons), cetylphenol mono-sulfide sulfonic acids, dilauryl beta naphthyl sulfonic acids, and alkaryl sulfonic acids such as dodecyl benzene "bottoms" sulfonic acids.

Dodecyl benzene "bottoms" sulfonic acids are the material leftover after the removal of dodecyl benzene sulfonic acids that are used for household detergents. These materials are generally alkylated with higher oligomers. The bottoms may be straight-chain or branched-chain alkylates with a straight-chain dialkylate preferred.

The production of sulfonates from detergent manufactured by-products by reaction with, e.g., $SO_3$, is well known to those skilled in the art. See, for example, the article "Sulfonates" in Kirk-Othmer "Encyclopedia of Chemical Technology," Second Edition, Vol. 19, pp. 291 et seq. published by John Wiley & Sons, N.Y. (1969).

The phenols useful in making the basic metal salts (c) of the invention can be represented by the formula $(R_1)_a$—Ar—$(OH)_b$, wherein $R_1$ is defined above; Ar is an aromatic group; a and b are independently numbers of at least one, the sum of a and b being in the range of two up to the number of displaceable hydrogens on the aromatic nucleus or nuclei of Ar. Preferably, a and b are independently numbers in the range of 1 to about 4, more preferably 1 to about 2. $R_1$ and a are preferably such that there is an average of at least about 8 aliphatic carbon atoms provided by the $R_1$ groups for each phenol compound.

While the term "phenol" is used herein, it is to be understood that this term is not intended to limit the aromatic group of the phenol to benzene. Accordingly, it is to be understood that the aromatic group as represented by "Ar" as well as elsewhere in other formulae in this specification and in the appended claims, can be mononuclear such as a phenyl, a pyridyl, or a thienyl, or polynuclear. The polynuclear groups can be of the fused type wherein an aromatic nucleus is fused at two points to another nucleus such as found in naphthyl, anthranyl, etc. The polynuclear group can also be of the linked type wherein at least two nuclei (either mononuclear or polynuclear) are linked through bridging linkages to each other. These bridging linkages can be chosen from the group consisting of alkylene linkages, ether linkages, keto linkages, sulfide linkages, polysulfide linkages of 2 to about 6 sulfur atoms, etc.

The number of aromatic nuclei, fused, linked or both, in Ar can play a role in determining the integer values of a and b. For example, when Ar contains a single aromatic nucleus, the sum of a and b is from 2 to 6. When Ar contains two aromatic nuclei, the sum of a and b is from 2 to 10. With a tri-nuclear Ar moiety, the sum of a and b is from 2 to 15. The value for the sum of a and b is limited by the fact that it cannot exceed the total number of displaceable hydrogens on the aromatic nucleus or nuclei of Ar.

The metal compounds useful in making the basic metal salts (c) are alkali, alkaline earth and transition metals. Preferably, any Group I or Group II metal compounds (CAS version of the Periodic Table of the Elements). The Group I metals of the metal compound include alkali metals (sodium, potassium, lithium, etc.) as well as Group IB metals such as copper. The Group I metals are preferably sodium, potassium, lithium and copper, more preferably sodium or potassium, and most preferably sodium. The Group II metals of the metal base include the alkaline earth metals (magnesium, calcium, barium, etc.) as well as the Group IIB metals such as zinc or cadmium. Preferably the Group II metals are magnesium, calcium, or zinc, preferably magnesium or calcium, more preferably magnesium. Generally the metal compounds are delivered as metal salts. The anionic portion of the salt can be hydroxide, oxide, carbonate, nitrate, and the like.

An acidic material is used to accomplish the formation of the basic metal salt (c). The acidic material may be a liquid such as formic acid, acetic acid, nitric acid, sulfuric acid, etc. Acetic acid is particularly useful. Inorganic acidic materials may also be used such as HCl, $SO_2$, $SO_3$, $CO_2$, $H_2S$, preferably $CO_2$. A preferred combination of acidic materials is carbon dioxide and acetic acid.

A promoter is a chemical employed to facilitate the incorporation of metal into the basic metal compositions. Among the chemicals useful as promoters are water, ammonium hydroxide, organic acids of up to about 8 carbon atoms, nitric acid, sulfuric acid, hydrochloric acid, metal complexing agents such as alkyl salicylaldoxime, and alkali metal hydroxides such as lithium hydroxide, sodium hydroxide and potassium hydroxide, and mono- and polyhydric alcohols of up to about 30 carbon atoms. Examples of the alcohols include but are not limited to methanol, ethanol, isopropanol, isobutyl alcohol, primary amyl alcohol, dodecanol, behenyl alcohol, ethylene glycol, monomethylether of ethylene glycol, hexamethylene glycol, glycerol, pentaerythritol, benzyl alcohol, phenylethyl alcohol, aminoethanol, cinnamyl alcohol, allyl alcohol, and the like. Especially useful are the monohydric alcohols having up to about 10 carbon atoms and mixtures of methanol with higher monohydric alcohols or especially in the case of magnesium, mixtures of methanol and water.

Patents specifically describing techniques for making basic salts of the above-described sulfonic acids, carboxylic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. The disclosures of these patents are hereby incorporated in this present specification for their disclosures in this regard as well as for their disclosure of specific suitable basic metal salts.

Component (c) is preferably a basic calcium or magnesium alkylbenzene-sulfonate. Component (c) is more preferably a basic magnesium alkylbenzenesulfonate, and most preferably a basic carbonated magnesium alkylbenzenesulfonate, which is made by overbasing with magnesium oxide in the presence of $CO_2$. Alternatively the basic magnesium sulfonate may be prepared by overbasing with magnesium oxide in a non-carbonating procedure, by hydration of the magnesium oxide to magnesium hydroxide during the process.

The amount of component (c) in the composition of the present invention are generally in the range of about 0.5% to about 4% by weight of the lubricating composition. Preferably the amount of component (c) is in the range of about 0.7% to about 3% by weight of the lubricating composition. More preferably the amount of component (c) is in the range of about 0.8% to about 2.5% by weight of the lubricating composition. In a preferred embodiment the basic metal salt (c) delivers in the range of about 0.1% to about 0.5% by weight of metal to the formulated oil or a sulfated ash of in the range of about 0.2% to about 1.5% by weight. In a more preferred embodiment (c) delivers in the range of about 0.2% to about 0.4% by weight of the metal or a sulfated ash of in the range of about 0.6% to about 1.2% by weight. Preferably the total base number (TBN) delivered by (c) is in the range of 2 to 15 expressed as units of milligrams of KOH/gram of sample, typically measured by titration with standardized HCl or HClO4 solutions.

Component (d) of the lubricating composition is a metal deactivator. These materials when used are active on metal surfaces providing enhancement of the friction and the antiwear characteristics as a booster to the performance of the amine phosphate (b) and basic metal salt (c). Examples of such materials include 2,5-dimercapto-1,3,4-thiadiazole and/or derivatives thereof. Such materials are described in European Patent Publication 0761805, incorporated herein by reference.

In one embodiment, of the present invention (a) through (c) is used in combination with (d) at least one metal deactivator. In this embodiment, the metal deactivator is present in an inventive lubricant or functional fluid composition in an amount sufficient to provide a metal deactivating effect and/or antiwear or friction enhancement.

The metal deactivators that are useful herein reduce the corrosion of metals, such as copper. Metal deactivators are also referred to as metal passivators. These metal deactivators are typically nitrogen and/or sulfur containing heterocyclic compounds, such as dimercaptothiadiazoles, triazoles, aminomercaptothiadiazoles, imidazoles, thiazoles, tetrazoles, hydroxyquinolines, oxazolines, imidazolines, thiophenes, indoles, indazoles, quinolines, benzoxazines, dithiols, oxazoles, oxatriazoles, pyridines, piperazines, triazines, and derivatives of any one or more thereof. The metal deactivator preferably comprises at least one triazole, which may be substituted or unsubstituted. Examples of suitable compounds are benzotriazole, alkyl-substituted benzotriazole (e.g., tolyltriazole, ethylbenzotriazole, hexylbenzotriazole, octylbenzotriazole, etc.), aryl-substituted benzotriazole (e.g., phenol benzotriazoles, etc.), and alkylaryl- or arylalkyl-substituted benzotriazole and substituted benzotriazoles where the substituent may be hydroxy, alkoxy, halo (especially chloro), nitro, carboxy and carboxyalkoxy. Preferably, the triazole is a benzotriazole or an alkylbenzotriazole in which the alkyl group contains 1 to about 20 carbon atoms, preferably 1 to about 8 carbon atoms. Benzotriazole and tolyltriazole are useful.

In one embodiment, the metal deactivator is the reaction product of a dispersant with a dimercaptothiadiazole. The dispersants may be generally characterized as the reaction products of carboxylic acids with amines and/or alcohols. These reaction products are commonly used in the lubricant arts as dispersants and are sometimes referred to generically as dispersants despite the fact that they may have other uses in addition to or instead of that as dispersants. The carboxylic dispersants include succinimide dispersants, ester type dispersants and the like. Succinimide dispersants are generally the reaction of a polyamine with an alkenyl succinic anhydride or acid. Ester type dispersants are the reaction product of an alkenyl succinic anhydride or acid with a polyol compound. The reaction product may then be further treated with an amine such as a polyamine. Examples of useful dispersants are disclosed in U.S. Pat. Nos. 3,219,666 and 4,234,435, incorporated herein by reference. Useful dispersants also include the ashless dispersants discussed below under the heading "Detergents and Dispersants." Generally the reaction occurs between the dispersant and the dimercaptothiadiazole by mixing the two and heating to a temperature above about 100° C. U.S. Pat. Nos. 4,140,643 and 4,136,043 describe compounds made by the reaction of such dispersants with a dimercaptothiadiazole. These patents are incorporated herein by reference for their disclosure of dispersants, dimercaptothiadiazole, the method for reacting the two and the products obtained from such reaction.

In one embodiment, the metal deactivator is the reaction product of a phenol with an aldehyde and a dimercaptothiadiazole. The phenol is preferably an alkyl phenol wherein the alkyl group contains at least about 6, preferably from 6 to about 24, more preferably about 6, or about 7, to about 12 carbon atoms. The aldehyde is preferably an aldehyde containing from 1 to about 7 carbon atoms or an aldehyde synthon, such as formaldehyde. Preferably, the aldehyde is formaldehyde or paraformaldehyde. The aldehyde, phenol and dimercaptothiadiazole are typically reacted by mixing them at a temperature up to about 150 C., preferably about 50 C. to about 130 C., in molar ratios of about 0.5 to about 2 moles of phenol and about 0.5 to about 2 moles of aldehyde per mole of dimercaptothiadiazole. Preferably, the three reagents are reacted in equal molar amounts.

In one embodiment, the metal deactivator is a bis (hydrocarbyldithio)thiadiazole. Preferably each hydrocarbyl group is independently an alkyl, aryl or aralkyl group, having from 6 to about 24 carbon atoms. Each hydrocarbyl can be independently t-octyl, nonyl, decyl, dodecyl or ethylhexyl. The metal deactivator can be bis-2,5-tert-octyldithio-1,3,4-thiadiazole or a mixture thereof with 2-tert-octylthio-5-mercapto-1,3,4-thiadiazole. These materials are available commercially under the trade name of Amoco 150, which is available from Amoco Chemical Company. These dithiothiadiazole compounds are disclosed as Component (d) in PCT Publication WO 88/03551, incorporated by reference for its disclosure of dithiothiadiazole compounds. In the preferred embodiments the metal deactivator is a dimercaptothiadiazole derivative. The following D-1 and D-2 are specific examples.

Example D-1

2,5-dimercapto-1,3,4-thiadiazole oxidatively coupled with t-nonyl mercaptan; 100% chemical, 36% S, 64% N.

Example D-2

Heptylphenol coupled with 2,5-dimercapto-1,3,4-thiadiazole using formaldehyde (the thiadiazole is generated in situ); 20% oil, 17.75% S, 5.5% N.

When used, the amount of component (d) in the lubricating composition of the present invention is generally in the range of about 0% to about 0.7% by weight of the lubricating composition. Preferably the amount of component (d) is in the range of about 0.03% to about 0.5% by weight of the lubricating composition. More preferably the amount of component (d) is in the range of about 0.1% to about 0.3% by weight of the lubricating composition.

Component (e) lubricating composition is a boron-containing dispersant. Specific examples of this type of component include but are not limited to borated succinimide dispersants and borated Mannich dispersants. Preferably the boron containing dispersant is a borated succinimide dispersant.

The borated dispersant are prepared by reacting a dispersant with a borating agent. The following examples E-1 and E-2 relate to borated succinimide dispersants.

Example E-1

A mixture of about 372 grams (6 equivalents of boron) of boric acid and about 3111 grams (6 equivalents of nitrogen) of an acylated nitrogen composition, obtained by reacting 1 equivalent of a polybutenyl (n=850) succinic anhydride, having an acid number of 113 (corresponding to an equivalent weight of 500), with 2 equivalents of a commercial ethylene amine mixture having an average composition corresponding to that of tetraethylenepentamine, is heated at about 150° C. for about 3 hours a then filtered. The filtrate is found to have a boron content of about 1.64% and a nitrogen content of about 2.56%.

Example E-2

(a) A reaction vessel is charged with about 1000 parts of a polybutenyl (Mn=1000) substituted succinic anhydride, having a total acid number of 108, with a mixture of about 275 grams of oil and about 139 parts of a commercial mixture of polyamines corresponding to about 85% E-100 amine bottoms and about 15% diethylenetriamine. The reaction mixture is heated to about 150° C. to about 160° C. and the reaction temperature is maintained for 4 hours. The reaction is blown with nitrogen to remove water.

(b) A reaction vessel is charged with about 1405 parts of the product of Example E-2(a), about 229 parts of boric acid, and about 398 parts of diluent oil. The mixture is heated to about 100° C. to about 150° C. and the temperature maintained until water distillate ceases. The final product contains about 2.3% nitrogen, about 1.9% boron, about 33% 100 neutral mineral oil and a total base number of 60.

The amount of component (e) in the lubricating composition of the present invention is generally in the range of about 0% to about 3% by weight of the lubricating composition. Preferably the amount of component (e) is in the range of about 0.05% to about 2.5% by weight of the lubricating composition. More preferably the amount of component (e) is in the range of about 0.1% to about 2% by weight of the lubricating composition. Preferably the amount of boron delivered by (e) is in the range of about 0.003% to about 0.2% B by weight.

The lubricating composition described above is prepared by blending the components (a) through (c) and optionally (d) and/or (e) in any order at normal blending conditions, usually with good mixing at a temperature in the range of about 25° C. to about 150° C. More typically in the range of about 50° C. to about 100° C. Typically the blending is done at normal atmospheric pressure for a time suitable to obtain a homogeneous solution, generally in the range of about 0.5 hour to about 24 hours, preferably in the range of about 1 hour to about 8 hours.

Other components that are conventionally employed in a gear oil or manual transmission oil may also be present. Among such components are oxidation inhibitors such as alkylated diphenylamine, rust inhibitors, antifoam agents, dispersants other than (e), friction modifiers such as oleyl amine, sulfurized olefins and the like. Preferably metal free sulfur containing anti-wear/extreme pressure agents such as sulfurized olefins, or hydrocarbyl sulfides or polysulfides are absent or if present in a low amount such as <0.1% of the lubricating composition.

The above components can be in the form of a fully formulated lubricant or in the form of a concentrate with a smaller amount of lubricating oil.

Sinter compositions useful for the manufacture of the sintered metal synchronizer ring for use in the synchromesh transmission vary in their metal content. They usually comprise a major amount of copper and/or iron and up to about 35% zinc and may also contain up to about 15% tin. In one embodiment the sinter compositions from which sintered metal parts are manufactured for use with the lubricant of this invention, may themselves additionally contain basic metal salts of organic acids, such as alkali metal or alkaline earth metal sulfonates. This leads to sintered parts with some built in wear protection. Particularly preferred are overbased magnesium sulfonates like those described above in the discussion of (c). The sinter compositions containing the basic metal salts of organic acids are put through a sintering operation to form the sintered articles. Such sinter compositions are described here as background for the manufacture of improved sintered parts that are useful in synchromesh manual transmissions. The compositions (manual transmission fluids) and methods of the present invention may be used advantageously with such manufactured sintered parts, as well as other types of manufactured sintered metal parts.

Specific Embodiment

The following examples demonstrate the advantages of the present invention. (See Table I)

(1) For each example (including the comparative examples 5C–8C) the base formulation was the following: a base oil which is a hydrogenated polyalpha olefin (PAO6) with a viscosity of 6 $mm^2$/sec, about 4.67% of an olefin copolymer viscosity modifier, about 0.35% of an amine phosphate (a C 1214 branched alkyl amine salt of example B-1), about 0.2% of nonylated diphenylamine (antioxidant), about 150 ppm of a polyacrylate foam inhibitor, about 60 ppm of a silicone foam inhibitor, about 0.2% of oleylamine friction modifier plus the variable amounts of the three other additives shown in the above table, the base oil makes up the balance which ranges from about 89% to about 94% PAO6 and small amount of mineral oil which is delivered with some of the components as a diluent. The amount of the component is on an "as is" basis containing the mineral oil diluent in the amount noted in the footnote below describing them. To obtain the neat component concentrate, one would need to subtract the diluent from the amounts shown in Table I.

(2) An overbased magnesium alkylbenzenesulfonate with a TBN of 400 and containing about 32% mineral oil diluent.

(3) A borated polyisobutylene succinimide dispersant with about 1.9% boron and about 33% mineral oil diluent (Example E-2)

(4) A dimercaptothiadiazole derivative (Example D-1), no diluent oil.

Testing of the compositions described above was carried out by using a test rig called the $\mu$-comp (Mu Comp Test). The test was designed to evaluate the effect manual transmission fluids and their component chemistries on sinter material Hoerbiger HS45 used in syncromesh parts. The sinter material is a composition of tin, zinc, copper carbon and other minor components. Initially the powdered mix is scattered on metal foil. This is heated in a hydrogen atmosphere to produce the sintering, then stamped out into syncro-rings The Mu Comp Test measures the coefficient of friction under certain loading conditions after a number of cycles of engaging and disengaging the sintered metal surfaces on mating cone shapes to simulate a manual transmission synchronizer. Wear and variability of the coefficient of friction are also measured. The desired performance is a consistent coefficient of friction generally between 0. 1 and 0.14.

The temperature of the fluid is about 80° C. and the cycling rate is about 600 cycles/hour. The differential speed (Δn) is about 1300 rpm and the surface loading is about 0.042 $kgm^2$.

TABLE I

| Examples of Formulated MTFs (1) | 1 | 2 | 3 | 4 | 5C | 6C | 7C | 8C | 9 |
|---|---|---|---|---|---|---|---|---|---|
| Components: | | | | | | | | | |
| Detergent (2) | 3 | 3 | 3 | 3 | — | — | — | — | 1.5 |
| Borated Dispersant (3) | 2 | 2 | 0.2 | 0.2 | 2 | 2 | 0.2 | 0.2 | 1.1 |
| Metal Deactivator (4) | 0.15 | — | 0.15 | — | 0.15 | — | 0.15 | — | 0.075 |
| Hoerbiger Mu Comp Test Results: | | | | | | | | | |
| Axial Wear (mm) at 10000 | 0.090, 0.100 | 0.130 | 0.050 | 0.170 | 0.130 | 0.110 | 0.080 | 0.080 | 0.110, 0.110 |
| Avg. coefficient at start of test | 0.093, 0.097 | 0.087 | 0.088 | 0.079 | 0.090 | 0.073, 0.087 | 0.094 | 0.086 | 0.095, 0.091 |
| Avg. coefficient at end of test | 0.110, 0.117 | 0.118 | 0.109 | 0.093 | 0.083 | 0.080, 0.081 | 0.088 | 0.084 | 0.103, 0.099 |

The improvement of using the inventive lubricating composition as seen in examples 1–4 and 9 is easily observed in the average coefficient at the end of the test. All have higher average coefficients of friction than the best comparative example 7C. In comparing the two inventive lubricating examples 3 and 4, it shows the contributive value of the metal deactivator, the dimercaptothiadiazole derivative contained. Example 3 with the metal deactivator has the higher average coefficient at the end of the test. Example 1 compared to 2, both containing the high level of the optional borated dispersant, shows the benefit of the metal deactivator giving higher average coefficient at the start of the test.

The contribution of the borated dispersant to the average coefficient at the end of the test can be seen in comparing examples 2 to 4. Example 2 with the higher level of borated dispersant has significantly higher average coefficients of friction at the start of the test and at the end of the test. The contribution of the optional borated dispersant does not seem to be discernable with the optional metal deactivator present in examples 1 and 3 as well as it is seen in comparing average coefficient at the end of the test for examples 2 and 4. The contribution of the borated dispersant is not seen within any of the comparative examples, as demonstrated in comparative examples 5C and 6C having a higher level of borated dispersant than 7C and 8C.

All of the comparative examples 5C–8C lack the basic metal detergent. The benefit of the overbased magnesium sulfonate appears to be a film building/friction stabilizing effect in that the values of average coefficient at the end of the test as opposed to values of average coefficient at the start of the test for all of the inventive examples 1–4 and 9.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the upper and lower amount, range, and ratio limits set forth herein may be independently combined.

From the above description and examples of the invention, those skilled in the art will perceive improvements, changes, modifications in the invention. Such improvement, changes and modifications within those skilled in the art are intended to be covered by the appended claims.

What is claimed is:

1. A method for preventing wear and improving performance in the synchronizer of a manual transmission by using a lubricant comprising:

(a) at least about 70% by weight of an oil of lubricating viscosity of at least one of API Group III, IV, V or mixtures thereof, (b) about 0.01% to about 2% by weight of an amine salt of a phosphorus-containing acid, (c) at least about 0.5% by weight of a basic metal salt of an organic acid, (d) about 0% to about 0.7% by weight of a metal deactivator compound, and (e) about 0% to about 3% by weight of a boron containing dispersant; and wherein the synchronizer in the manual transmission has sintered metal surfaces.

2. A method according to claim 1 wherein the basic metal salt (c) is an alkaline earth metal salt.

3. A method according to claim 2 wherein the alkaline earth metal salt is selected from the group consisting of an overbased magnesium salt, an overbased calcium salt or combinations thereof.

4. A composition according to claim 3 wherein the alkaline earth metal salt is an overbased magnesium sulfonate.

5. A method according to claim 2 wherein the metal deactivator is a dimercaptothiadiazole derivative.

6. A method according to claim 4 wherein the metal deactivator is a dimercaptothiadiazole derivative.

7. A method according to claim 2 wherein the oil of lubricating viscosity is at least 30% by weight polyalphaolefin (PAO, API Group IV).

8. A method according to claim 6 wherein the oil of lubricating viscosity is at least 50% by weight polyalphaolefin (PAO, API Group IV).

9. A method according to claim 2 wherein component (e) is present at as a borated succinimide dispersant.

10. A method according to claim 8 wherein component (e) is present as a borated succinimide dispersant.

11. A method for preventing wear and improving performance in the synchronizer of a manual transmission by using a lubricant comprising:

(a) at least about 70% by weight polyalphaolefin (PAO) synthetic oil of lubricating viscosity, (b) about 0.05% to about 1.5% by weight of an amine phosphate extreme pressure agent, (c) at least about 0.7% by weight overbased magnesium sulfonate, (d) about 0.03% to about 0.5% by weight of a dimercaptothiadiazole derivative, and (e) about 0.1% to about 2.5% by weight of a borated succinimide dispersant; and wherein the synchronizer in the manual transmission has sintered metal surfaces.

12. A method for lubricating a manual transmission designed with synchronizer, using a lubricant comprising the following components:

(a) at least about 70% by weight polyalphaolefin (PAO) synthetic oil of lubricating viscosity, (b) about 0.05% to about 1.5% by weight of an amine phosphate extreme pressure agent, (c) at least about 0.7% by weight overbased magnesium sulfonate, and (d) about 0.03% to about 0.5% by weight of a dimercaptothiadiazole derivative; with the proviso that the lubricant contains less than about 0.1% by weight of a metal free sulfur containing antiwear/extreme pressure agent, and wherein the synchronizer in the manual transmission has sintered metal surfaces.

13. A method according to claim 12 with a lubricant composition further comprises (e) a borated succinimide dispersant.

14. A method for lubricating a manual transmission designed with synchronizer, using a lubricant comprising:

(a) at least about 70% by weight polyalphaolefin (PAO) synthetic oil of lubricating viscosity, (b) about 0.05% to about 1.5% by weight of an amine phosphate extreme pressure agent, (c) at least about 0.7% by weight overbased magnesium sulfonate, (d) about 0.03% to about 0.5% by weight of a dimercaptothiadiazole derivative, and (e) about 0.1% to about 2.5% by weight of a borated succinimide dispersant; and wherein the synchronizer in the manual transmission has sintered metal surfaces.

15. A method for preventing wear and improving performance in the synchronizer of a manual transmission by using a lubricant comprising:

(a) at least about 70% by weight polyalphaolefin (PAO) synthetic oil of lubricating viscosity, (b) about 0.05% to about 1.5% by weight of an amine phosphate extreme pressure agent, (c) at least about 0.7% by weight overbased magnesium sulfonate, (d) about 0.03% to about 0.5% by weight of a dimercaptothiadiazole derivative, (e) about 0.1% to about 2.5% by weight of a borated succinimide dispersant, and wherein the synchronizer in the manual transmission has sintered metal surfaces manufactured from a basic metal salt of an organic acid in the sinter composition.

16. The method of claim 15 wherein the basic metal salt of an organic acid in the sintered composition is an overbased magnesium sulfonate.

* * * * *